US011878830B2

(12) United States Patent
Beliveau

(10) Patent No.: US 11,878,830 B2
(45) Date of Patent: Jan. 23, 2024

(54) CONTAINER FOR CONSUMER PRODUCTS

(71) Applicant: SINOMAX-USA, INC., Houston, TX (US)

(72) Inventor: John Austin Beliveau, Mooresville, NC (US)

(73) Assignee: SINOMAX-USA, Inc., Houston, TX (US)

( * ) Notice: Subject to any disclaimer, the term of this patent is extended or adjusted under 35 U.S.C. 154(b) by 289 days.

(21) Appl. No.: 16/912,100

(22) Filed: Jun. 25, 2020

(65) Prior Publication Data

US 2020/0407145 A1 Dec. 31, 2020

Related U.S. Application Data

(60) Provisional application No. 62/866,402, filed on Jun. 25, 2019.

(51) Int. Cl.

| | |
|---|---|
| ***A47C 27/15*** | (2006.01) |
| ***B65D 81/18*** | (2006.01) |
| ***B65D 65/40*** | (2006.01) |
| ***B65D 85/07*** | (2017.01) |
| *A47G 9/02* | (2006.01) |
| *A47G 9/10* | (2006.01) |
| *A47C 21/04* | (2006.01) |

(52) U.S. Cl.

CPC ..... *B65D 81/18* (2013.01); *B65D 65/40* (2013.01); *B65D 85/07* (2018.01); *A47C 21/046* (2013.01); *A47G 9/0215* (2013.01); *A47G 9/1036* (2013.01)

(58) Field of Classification Search

CPC ..... A47C 27/15; A47C 7/746; A47C 31/001; A47C 21/046; B65D 5/4212; B65D 2203/12

See application file for complete search history.

(56) References Cited

U.S. PATENT DOCUMENTS

| | | | | |
|---|---|---|---|---|
| 2005/0150049 | A1* | 7/2005 | Schmidt | A47G 9/1036 5/502 |
| 2007/0000484 | A1* | 1/2007 | Magill | C09K 5/063 126/263.02 |
| 2015/0351557 | A1* | 12/2015 | Allen | A47C 27/085 5/652 |
| 2016/0166074 | A1* | 6/2016 | Rose | B68G 11/04 5/636 |
| 2019/0086158 | A1* | 3/2019 | Hirschfeld | F28F 23/00 |
| 2020/0279142 | A1* | 9/2020 | Matsutani | G06K 19/06037 |
| 2020/0377278 | A1* | 12/2020 | Orsini | B65B 55/20 |
| 2021/0025660 | A1* | 1/2021 | Bergida | C09K 5/063 |

* cited by examiner

*Primary Examiner* — David R Hare
*Assistant Examiner* — Ifeolu A Adeboyejo
(74) *Attorney, Agent, or Firm* — Patterson + Sheridan, LLP

(57) ABSTRACT

Embodiments of the disclosure relate to a container for a product having a cooling effect. In one embodiment, a container for housing a consumer product includes a body having an outer surface and a cooling material coupled to the outer surface of the body. The product contained in the container also includes the cooling material. By including the cooling material on the outer surface of the container, consumers can feel the cooling effect of the product without opening up the container.

19 Claims, 1 Drawing Sheet

CONTAINER FOR CONSUMER PRODUCTS

CROSS-REFERENCE TO RELATED APPLICATIONS

This application claims benefit of U.S. provisional patent application No. 62/866,402, filed on Jun. 25, 2020, which application is incorporated herein by reference in its entirety.

BACKGROUND

Field

Embodiments of the disclosure relate to a container for consumer products. In particular, embodiments of the disclosure relate to a container for a product having a cooling effect.

Description of the Related Art

Containers for consumer products that serve to hold and display products for sale to end-users are commonly used for a variety of products. Typically, consumer products are visually displayed on the container. However, such container with the visual display of the product contained therein often do not communicate the properties of the product that can be felt by a consumer. For example, for a bedding product, such as a pillow or mattress, the product may have a cooling effect on the user. The container having the visual display of its product cannot communicate the cooling effect to a consumer.

Therefore, an improved container for consumer products is needed.

SUMMARY

Embodiments of the disclosure relate to a container for consumer products. In particular, embodiments of the disclosure relate to a container for a product having a cooling effect. In one embodiment, a container for housing a consumer product includes a body having an outer surface and a cooling material coupled to the body.

In another embodiment, a packaged consumer product includes a container having a body having an outer surface. The container further includes a cooling material coupled to the outer surface. The packaged consumer product further includes a consumer product disposed in the container.

BRIEF DESCRIPTION OF THE DRAWINGS

So that the manner in which the above recited features can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
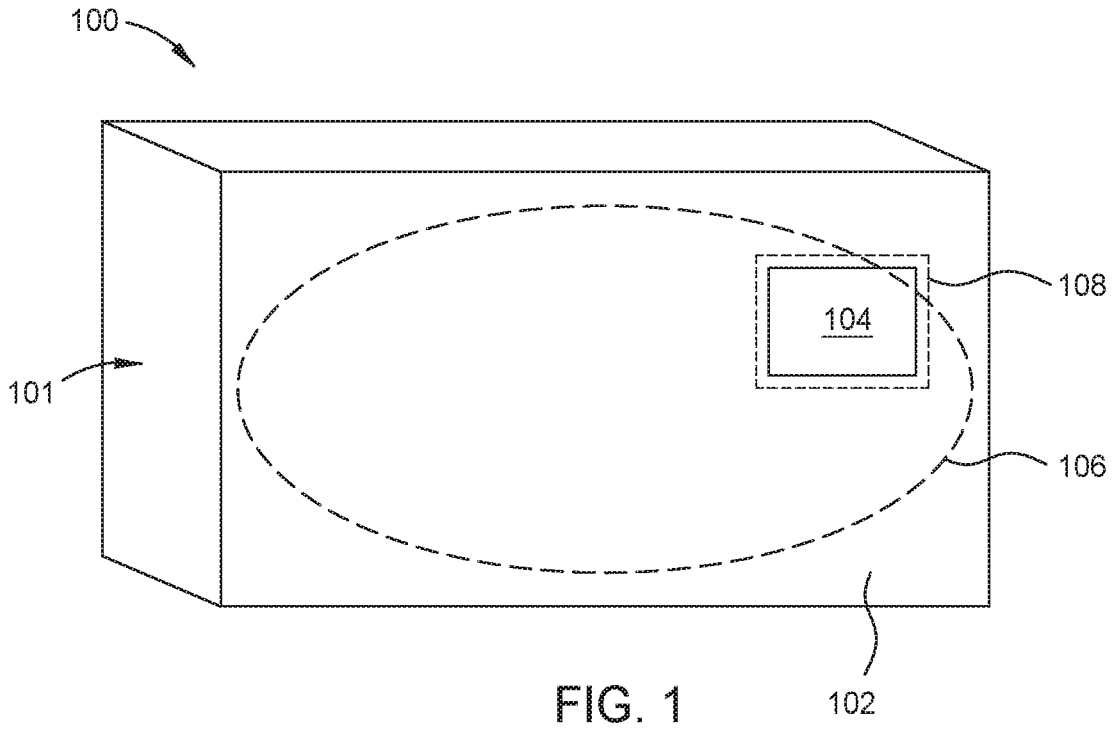
FIG. 1 illustrates a container for containing a consumer product according to one embodiment described herein.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Embodiments of the disclosure relate to a container for consumer products. In particular, embodiments of the disclosure relate to a container for a product having a cooling effect. In one embodiment, a container for containing a consumer product includes a body having an outer surface and a cooling material coupled to the outer surface of the body. The product disposed in the container also includes the cooling material. By including the cooling material on the outer surface of the container, consumers can feel the cooling effect of the product without opening the container.

FIG. 1 illustrates a container 100 for containing a consumer product 106 according to one embodiment described herein. As shown in FIG. 1, the container 100 includes a body 101 having an outer surface 102, an internal space, and a cooling material 104 coupled to the outer surface 102. The body 101 may be fabricated from any suitable material, such as paper, cardboard, plastic, polymer, or other suitable material. The body 101 may have any suitable shape, such as cuboid, cylinder, cone, sphere, polygon, or other suitable shape for housing the product. In one embodiment, the container 100 may be a packaging for consumer products.

The consumer product 106 disposed in the container 100 may be any consumer product having a cooling effect on a user. For example, the consumer product 106 contained in the container 100 may be a pillow, a mattress, or other cushion-type products. The consumer product 106 produces a cooling effect on the user of the consumer product 106.

As shown in FIG. 1, the container 100 includes a body 101 having an outer surface 102 and an internal space for storing the consumer product 106. Visual display of the consumer product 106 may be printed on the outer surface 102 of the container 100. In order to communicate the cooling effect of the consumer product 106 to the consumers, the cooling material 104 used in the consumer product 106 is coupled to the outer surface 102. The cooling material 104 may be a temperature regulating material that can transfer heat away from a user in contact with the cooling material 104. The cooling material 104 provides a cooling feeling to a consumer who touches the cooling material 104, relative to the outer surface 102 of the container 100. The cooling material 104 may be coupled to one portion of the outer surface 102, as shown in FIG. 1, or to multiple portions of the outer surface 102.

The cooling material 104 may be any suitable cooling material, such as phase-change material (PCM), metal infused fiber, or other suitable cooling material. The PCM is a substance with a high heat of fusion, which is capable of storing large amounts of energy. Heat is absorbed when the material changes from one phase to a different phase, such as from solid to liquid. The PCM may be any commercially available phase-change material, such as organic or inorganic materials. Examples of organic phase change material are paraffin derived, carbohydrate derived, or lipid derived. An example of inorganic phase change material is salt hydrates. Commercially available PCMs are typically in the form of solutions. In some embodiments, the cooling material 104 includes copper, such as copper incorporated PCM, copper fused fiber, or other suitable copper containing cooling material.

The cooling material 104 may be coupled to the outer surface 102 using any suitable method, such as spray, roll, brush, or print. The cooling material 104 may be coupled to the outer surface 102 directly or indirectly. The cooling material 104 may be coupled to a portion of the outer surface 102 of the container 100. In one embodiment, the cooling material 104 is indirectly coupled to the outer surface 102 of the container 100. For example, the cooling material 104 is first coupled to a medium 108, and the medium 108 is coupled to the outer surface 102. The medium 108 may be attached to the outer surface 102 by any suitable method, such as adhesion, stapling, or other suitable method. For example, the medium 108 can be paper, polymer, or fabric, and the cooling material 104 is printed on the medium 108. The medium 108 with the cooling material 104 is then attached to the outer surface 102 of the container 100. In one example, the cooling material 104 is printed on a paper label, and the paper label is affixed to the outer surface 102 of the container 100. In another example, the cooling material 104 is printed on a sticker, and the sticker is affixed to the outer surface 102 of the container 100, which can be fabricated from any suitable material, such as cardboard or plastic. The medium 108 may be larger than the cooling material 104, as shown in FIG. 1. In some embodiments, the medium 108 has the same size as the cooling material 104.

In some embodiments, the cooling material 104 is directly coupled to the outer surface 102 of the container 100. The cooling material 104 may be sprayed, brushed, rolled, or printed on the outer surface 102 of the container 100. For example, the cooling material 104 can be sprayed, rolled, or printed on a predetermined portion of the outer surface 102 of the container 100.

Figure 2:
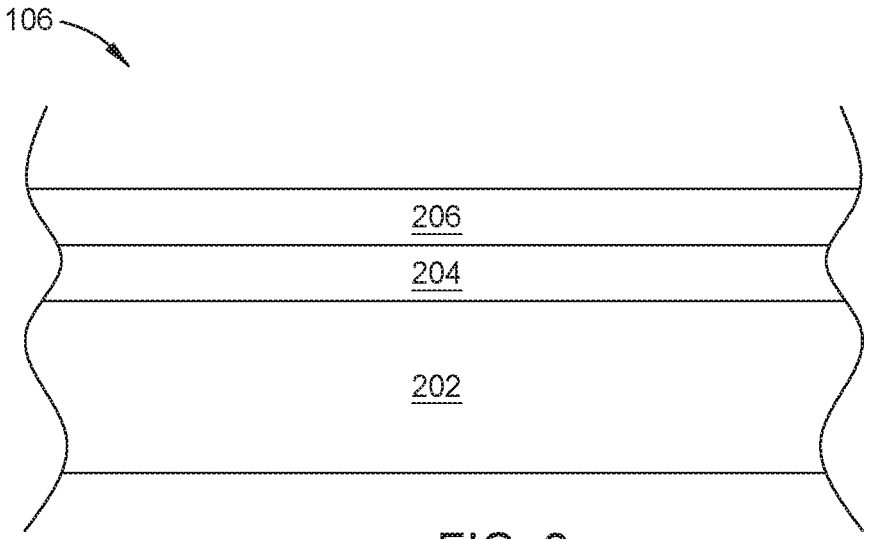
FIG. 2 is a schematic cross-sectional side view of the consumer product of FIG. 1 according to one embodiment described herein.

FIG. 2 is a schematic cross-sectional side view of the consumer product 106 of FIG. 1 according to one embodiment described herein. The consumer product 106 may be any suitable product that can produce a cooling effect on a user. For example, the consumer product 106 is cool to the touch by a user. Examples of the consumer product 106 include bedding products, such as pillows, mattresses, blankets, or cushion-type products. As shown in FIG. 2, the consumer product 106 includes a bulk layer 202, a cooling material layer 204 disposed on the bulk layer 202, and an optional cover 206 disposed on the cooling material layer 204. The cooling material layer 204 may be attached to or separate from the bulk layer 202. The optional cover 206 may be attached to or separate from the cooling material layer 204. The cooling material layer 204 may cover one side of the bulk layer 202, as shown in FIG. 2. In some embodiments, the cooling material layer 204 covers all sides of the bulk layer 202. Similarly, the cover 206 may cover one side or all sides of the bulk layer 202.

The bulk layer 202 may be fabricated from a material that can provide support to a user. In one embodiment, the bulk layer 202 is fabricated from memory foam. In another embodiment, the bulk layer 202 is fabricated from down or feather. In yet another embodiment, the bulk layer 202 is fabricated from fiber. In some embodiments, the bulk layer 202 includes multiple layers. For example, the bulk layer 202 may include a foam layer and a gel layer disposed on the foam layer.

The cooling material layer 204 is a layer of the cooling material 104 shown in FIG. 1. The cooling material layer 204 provides a cooling effect to a user. For example, the consumer product 106 may be a cooling pillow including at least a foam layer and the cooling material layer 204. The cooling material layer 204 provides a cool feeling as a user sleeps on the pillow by absorbing the head heat from the user. In order for a consumer to feel the coolness produced by the cooling material layer 204 without opening the container 100 (shown in FIG. 1), the cooling material 104 is coupled to the outer surface 102 of the container 100 (shown in FIG. 1).

In one embodiment, a container for housing a consumer product includes a body having an outer surface and a cooling material coupled to the outer surface.

In another embodiment, a packaged consumer product includes a container and a consumer product disposed in the container. In one embodiment, the container includes a body having an outer surface and a cooling material coupled to the outer surface.

In one or more of the embodiments described herein, the body has a cuboid shape.

In one or more of the embodiments described herein, the body is fabricated from cardboard.

In one or more of the embodiments described herein, the cooling material comprises a phase-change material.

In one or more of the embodiments described herein, the cooling material further comprises copper.

In one or more of the embodiments described herein, the cooling material is coupled to a medium, and the medium is coupled to the outer surface of the body.

In one or more of the embodiments described herein, the medium comprises paper or fabric.

In one or more of the embodiments described herein, the consumer product comprises the cooling material.

In one or more of the embodiments described herein, the consumer product is a bedding product.

In one or more of the embodiments described herein, the consumer product is a pillow.

In one or more of the embodiments described herein, the pillow comprises a bulk layer and a cooling material layer.

In one or more of the embodiments described herein, the cooling material layer is fabricated from the same material as the cooling material.

In one or more of the embodiments described herein, the container comprises a packaging for the consumer product.

While the foregoing is directed to embodiments of the invention, other and further embodiments of the invention may be devised without departing from the basic scope thereof, and the scope thereof is determined by the claims that follow.

The invention claimed is:

1. A container for housing a bedding product, comprising:
- a body having an outer surface, the body having an internal space configured to house the bedding product; and
- a cooling material coupled to the outer surface, wherein the bedding product comprises a product material that is the same as the cooling material.

2. The container of claim 1, wherein the body has a cuboid shape.

3. The container of claim 1, wherein the body is fabricated from cardboard.

4. The container of claim 1, wherein the cooling material comprises a phase-change material.

5. The container of claim 4, wherein the cooling material further comprises copper.

6. The container of claim 1, wherein the cooling material is coupled to a medium, and the medium is coupled to the outer surface of the body.

7. The container of claim 6, wherein the medium comprises paper or fabric.

8. A packaged bedding product, comprising:
- a container, comprising:
  - a body having an outer surface; and
  - a cooling material coupled to the outer surface; and a bedding product disposed in the container, wherein the bedding product comprises a product material that is the same as the cooling material.

9. The packaged bedding product of claim 8, wherein the body is fabricated from cardboard.

10. The packaged bedding product of claim 8, wherein the cooling material and the product material comprises a phase-change material.

11. The packaged bedding product of claim 10, wherein the cooling material and the product material further comprises copper.

12. The packaged bedding product of claim 8, wherein the cooling material is coupled to a medium, and the medium is coupled to the outer surface of the body.

13. The packaged bedding product of claim 12, wherein the medium comprises paper or fabric.

14. The packaged bedding product of claim 8, wherein the bedding product is a pillow.

15. The packaged bedding product of claim 14, wherein the pillow comprises a bulk layer and a cooling layer comprising the product material.

16. The packaged bedding product of claim 8, wherein the body has a cuboid shape.

17. The container of claim 1, wherein the container comprises a packaging for the bedding product.

18. The packaged bedding product of claim 8, wherein the product material is disposed between a cover and a bulk layer.

19. The container of claim 1, wherein the product material is disposed between a cover and a bulk layer.

* * * * *